US006042382A

United States Patent [19]

Halfhill

[11] Patent Number: 6,042,382

[45] Date of Patent: Mar. 28, 2000

[54] SUSTAINED G-FORCE CENTRIPETAL ACCELERATION APPARATUS AND METHOD

[76] Inventor: Robert Halfhill, 4031 Liberty Canyon Rd., Agoura Hills, Calif. 91301

[21] Appl. No.: 08/754,492

[22] Filed: Nov. 20, 1996

[51] Int. Cl.[7] ..... A63G 31/16; G09B 9/10

[52] U.S. Cl. ..... 434/59; 434/55; 472/31; 472/39; 472/47; 472/60

[58] Field of Search ..... 434/34, 55, 59, 434/69; 472/31, 39, 47, 59, 60; 74/573 F

[56] References Cited

U.S. PATENT DOCUMENTS

| | | | |
|---|---|---|---|
| 487,490 | 12/1892 | Motte . | |
| 1,521,858 | 1/1925 | Bock | 74/573 F |
| 1,789,680 | 1/1931 | Gwinnett | 472/60 |
| 1,863,653 | 6/1932 | Estes | 472/31 |
| 2,017,099 | 10/1935 | Kuzel . | |
| 2,101,274 | 12/1937 | Stanzel | 434/55 |
| 2,319,327 | 5/1943 | Johnson . | |
| 2,864,615 | 12/1958 | Castille | 472/31 |
| 3,136,075 | 6/1964 | Brian | 434/34 |
| 3,196,557 | 7/1965 | Davidsen et al. | 472/31 |
| 3,209,468 | 10/1965 | Frisch . | |
| 3,436,841 | 4/1969 | Whitmore et al. | 434/34 |
| 3,628,829 | 12/1971 | Heilig | 472/59 |
| 3,732,630 | 5/1973 | Crosbie et al. | 434/40 |
| 4,295,387 | 10/1981 | Zhivotov et al. | 74/573 F |
| 4,710,128 | 12/1987 | Wachsmuth et al. | 434/59 |
| 4,973,042 | 11/1990 | Klope et al. . | |
| 5,051,094 | 9/1991 | Richter et al. . | |
| 5,052,932 | 10/1991 | Trani . | |
| 5,197,010 | 3/1993 | Andersson | 74/573 F |
| 5,395,290 | 3/1995 | Knijpstra . | |
| 5,498,161 | 3/1996 | Noble, Jr. . | |
| 5,499,920 | 3/1996 | Trumbull . | |
| 5,558,582 | 9/1996 | Swensen et al. | 472/59 |
| 5,564,983 | 10/1996 | Larson . | |

FOREIGN PATENT DOCUMENTS

| | | | |
|---|---|---|---|
| 562428 | 9/1993 | European Pat. Off. | 472/31 |
| 1715373 | 2/1992 | U.S.S.R. | 472/31 |

*Primary Examiner*—Richard J. Apley
*Assistant Examiner*—Victor K. Hwang
*Attorney, Agent, or Firm*—Thorpe, North & Western

[57] ABSTRACT

A centripetal acceleration movement apparatus includes a base support having a rotatable portion rotatably disposed about a first axis. A plurality of carrying pods are attached to the rotatable portion of the base support and are positioned remotely with respect to the first axis for carrying at least one passenger. A rotating device is provided for rotating the rotatable portion of the base support about the first axis and thereby causing the attached carrying pod to (i) orbit the first axis along an orbital movement path and (ii) apply a centripetal force to the at least one passenger. A motion picture device is provided for producing a motion picture display confined to orbital movement with the carrying pods in a manner sufficient to enable the motion picture display to be viewed by a seeing passenger being carried by the carrying pods. The apparatus may also include variable balancing means for counter-balancing the carrying pods about the first axis responsive to changes in position of the center of mass of the carrying pods, to thereby maintain the center of mass substantially coincident with said first axis.

4 Claims, 11 Drawing Sheets

SUSTAINED G-FORCE CENTRIPETAL ACCELERATION APPARATUS AND METHOD

BACKGROUND OF THE INVENTION

1. The Field of the Invention

The present invention relates generally to educational or entertainment devices incorporating (i) motion for a rider and (ii) a sustained g-force. More particularly, the present invention relates a device and method for orbiting a rider or passenger about an axis of orbit in order to produce a centripetal force on the passenger which can simulate a sense of acceleration, deceleration, or zero gravity depending on how the passenger is oriented while being orbited.

2. The Background Art

Simulators have been used in such applications as flight training and amusement park rides. A simulator coordinates a visual display with limited movements to simulate a variety of environments and motions. A typical simulator comprises an open or enclosed motion or flying platform upon which a number of passengers are seated. The simulator incorporates a visual display, such as a motion picture. The flying platform is attached to a base unit by actuators. The actuators impart short bursts of force on both the flying platform and users in coordination with the visual display. Simulators must rely heavily on the visual display to simulate a sense of acceleration and thereby attempt to accentuate the limited motion of the actuators.

One attempt to overcome the limitations of conventional acceleration simulators is shown in U.S. Pat. No. 5,052,932 (issued on Oct. 1, 1991 to Trani). The Trani patent discloses a rotational sphere rotating in a base. The sphere contains seats for passengers and a visual display. By rotating the sphere, a centripetal force is applied to the passengers. One problem with this type of simulator is that it lacks a means for imparting a variety of movement sensations to a rider which would facilitate a "full range of motion" experience.

OBJECTS AND SUMMARY OF THE INVENTION

It is an object of the present invention to provide an apparatus and method for producing a sustained g-force as part of a full range of motion.

It is another object of the present invention, in accordance with one aspect thereof, to provide an apparatus and method for producing a sustained g-force in combination with at least one other force.

It is yet another object of the present invention, in accordance with one aspect thereof, to provide an apparatus and method for producing a sustained g-force in combination with at least one other sensory stimulation.

It is a further object of the present invention, in accordance with one aspect thereof, to provide an apparatus and method for producing a sustained g-force in combination with various orientations of a passenger in order to simulate acceleration, deceleration, and zero gravity.

Still another object of the present invention, in accordance with one aspect thereof, is to provide an apparatus and method for counter-balancing a sustained g-force motion device about an axis of orbit.

It is another object of the present invention to provide an apparatus and method for producing a sustained g-force in an amusement ride.

These and other objects and advantages of the present invention are realized in an apparatus and method that orbits a passenger about an axis of rotation in order to create a centripetal force on the passenger. Additional forces may be added by actuators to roll, pitch, turn, heave, surge, and laterally move the passenger. Other sensory stimulations may be used such as a visual display, sound system, smoke or fog, smells, air jets or fans, mist, heater or air cooler, and taste. The centripetal force, additional forces, and sensory stimulations combine to create a perception of reality in various movements and environments.

In a preferred embodiment of the present invention, a number of passengers are seated in a pod. The pod is preferably enclosed and contains seats and safety restraints. A visual display, sound system, and other sensory simulators are incorporated into the pod. The pod may be shaped and decorated to correspond to various themes. The pod is orbited about an axis of orbit to create a centripetal force on the passengers. Two or more pods may be orbited simultaneously in order to balance each other.

The pods are preferably attached to a flying platform by a rotational bearing. The rotational bearing allows the pod to rotate about an axis of rotation distinct from the axis of orbit and allows the pod to be oriented in various positions as it orbits. Thus, the pod may be rotated to orient the passengers so that they are facing toward the axis of orbit. The centripetal force will then simulate a forward acceleration. If the pod is rotated to orient the passengers so they are facing away from the axis of orbit, then the centripetal force will simulate deceleration. Furthermore, if the pod is rotated about the axis of rotation at the same time, but in a different direction, as it is being orbited about the axis of orbit, a perception of zero gravity can be produced at certain rotational positions of the pod.

The flying platform can be movably attached to a motion base by actuators. The actuators apply additional forces to the pod and passengers. The actuators may roll, pitch, turn, heave, surge, and laterally move the pod. A vertical column, concentric with the axis of orbit, is attached to the motion base. The flying platform is movably attached to the vertical column by a universal joint. The universal joint and column stabilize the pods and maintain the pods orbital rotation. The universal joint also allows the actuators to move the pod.

The motion base can be disposed on a circular track. The circular track defines a circular motion path about the axis of orbit. The motion base moves along the circular motion path, thus orbiting the passengers and pod around the axis of orbit and creating a centripetal force on the passengers.

More than one pod may be used to counter balance each other as they orbit the axis of orbit. In addition, a variable balancing means may be used to further counter balance the pods. The balancing means is preferably incorporated within the orbiting means and pods. Sensors determine the weight distribution throughout the orbiting means. A weight material, preferably water, is then distributed and positioned appropriately to balance the pods. In a preferred embodiment of the present invention, water tanks are positioned on the pods and communicate with a central storage tank. Sensors determine the weight distribution of the pods about the axis of orbit, and a pump distributes water from the central tank into the tanks on the pods to balance the pods such that the collective center of mass of the pods coincides with the axis of orbit.

In a further alternative embodiment of the present invention, the flying platform is attached to the motion base by a rotational bearing and the pod is attached to the flying platform by the actuators. Thus, the pod and the flying platform are rotated about an axis of rotation and the flying platform is not attached to a column.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
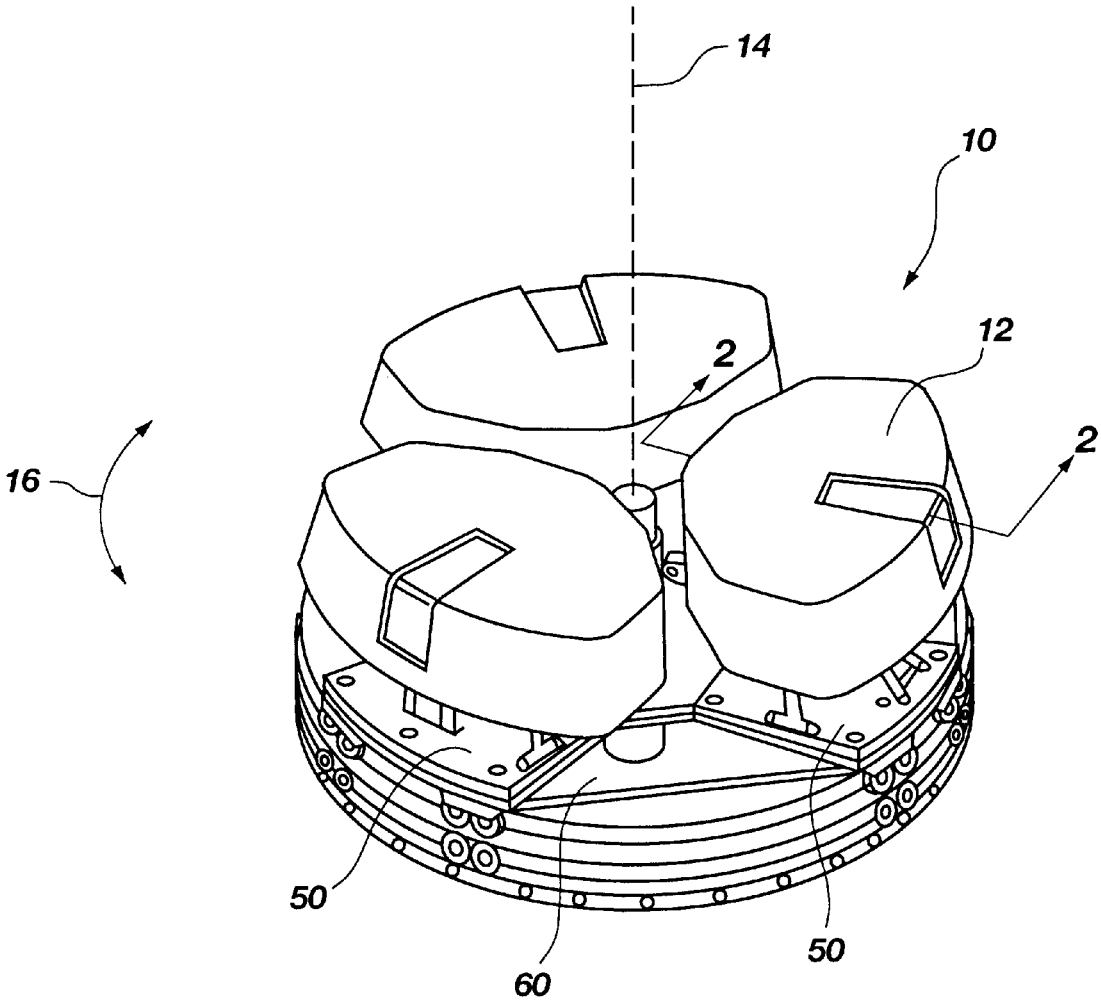
FIG. 1 is a perspective view of a centripetal acceleration movement apparatus, made in accordance with the principles of the present invention.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the illustrated apparatus, and any additional applications of the principles of the invention as illustrated herein, which would normally occur to one skilled in the relevant art and possessed of this disclosure, are to be considered within the scope of the invention claimed.

A preferred embodiment is illustrated in FIGS. 1–10. Referring now to FIG. 1, a sustained g-force motion device 10 in accordance with a preferred embodiment of the present invention is shown. The device 10 simulates a sustained G-force by orbiting (as indicated schematically by arrow 16) a pod 12 about an axis of orbit 14. The pod 12 contains at least one passenger (not shown). By orbiting the pod 12 about the axis of orbit 14, the device 10 creates a centripetal force (shown schematically at 18) on the passenger.

Figure 2:
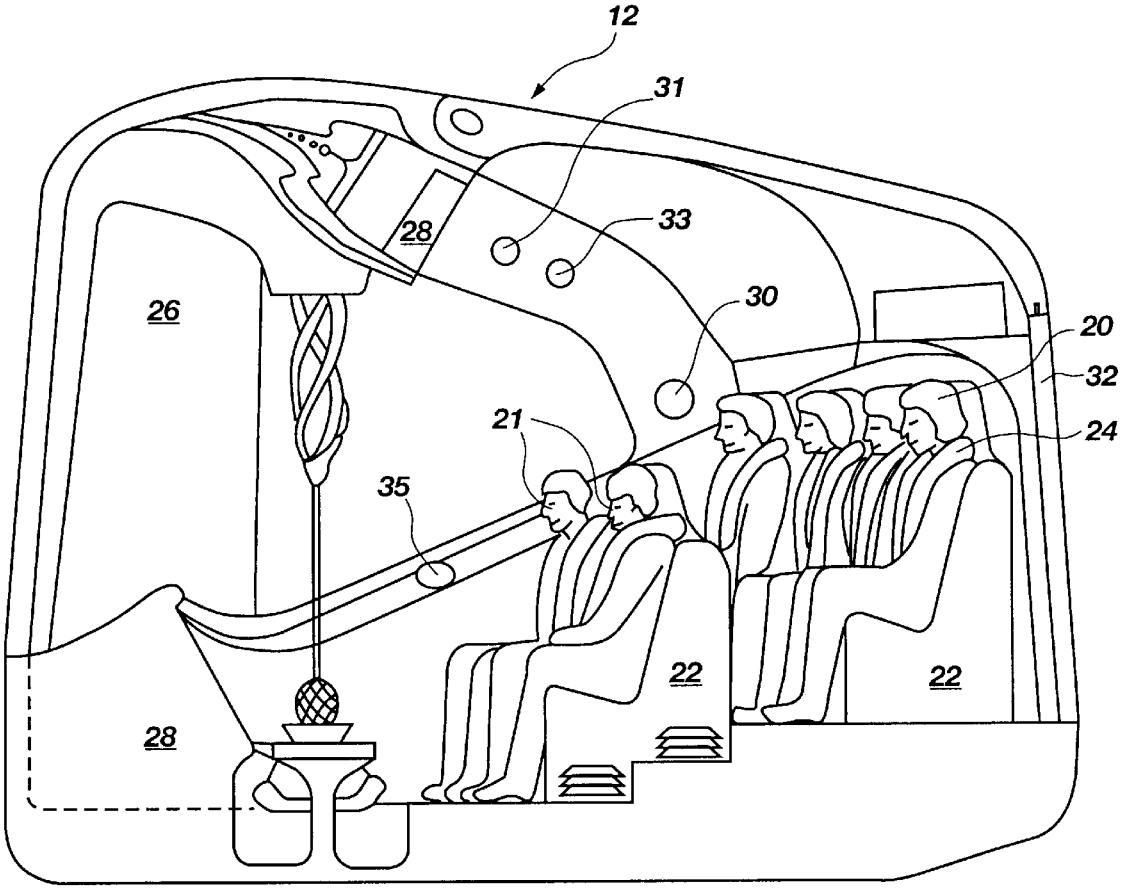
FIG. 2 is a cross sectional view of a pod taken along section 2—2 of FIG. 1.

As illustrated in FIG. 2, the pod 12 is preferably configured to hold a plurality of passengers 20. The pod 12 is preferably an enclosure so that the passengers 20 are isolated from outside reference points and stimulus. The pod 12 contains a seating assembly 22, safety restraints 24, and a door 32. The seating assembly 22 is positioned to face a primary visual display 26. Other visual displays 28 may also be included. In addition, a sound system 30 may optionally be incorporated into the pod 12.

The primary visual display 26 may comprise any type of well known display such a 70 mm film projector and screen, video screen, digital display, liquid crystal display (LCD) and the like. The primary display 26 is configured in the pod 12 so that it appears to be a window or windshield. The primary display 26 generates a visual image that appears to be the environment outside of the pod 12. For example, the primary display may generate an image of a planet's surface so that the passengers 20 perceive that the pod 12 is actually on that planet's surface. In addition, the primary display may show a moving picture from a perspective that gives the passenger a sense that the pod 12 is moving, such as a race car track. The other visual displays 28 are used to enhance the primary visual display 26, and may comprise the same type of visual display machinery used as the primary display 26. The other displays 28 may mimic displays such as gauges, dials, radar screens, system analysis and the like.

The pod 12 may be shaped, configured, and decorated according to a theme. For example, the interior of the pod 12 may be decorated so that it appears to be the interior of an alien space craft or a race car.

Alternatively, the pod 12 may be eliminated and the passengers 20 may be orbited about the axis of orbit 14 in the seating assembly 22, which would operate as an open-air, unenclosed carrying means in that case. Alternative to incorporating the visual display 28 into the pod 12, the passenger 20 may instead wear visual display goggles shown in phantom line at 21, in which the visual display is projected.

Figure 3:
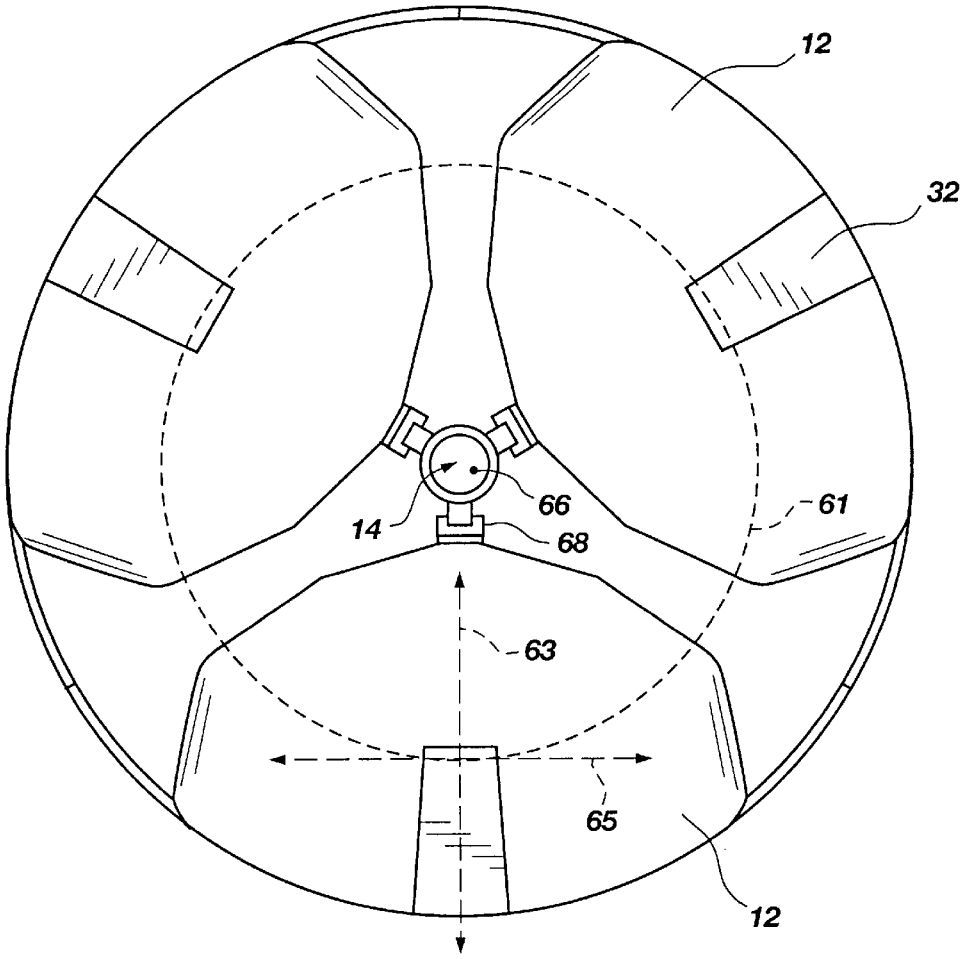
FIG. 3 is a top view of the apparatus of FIG. 1.
Figure 4:
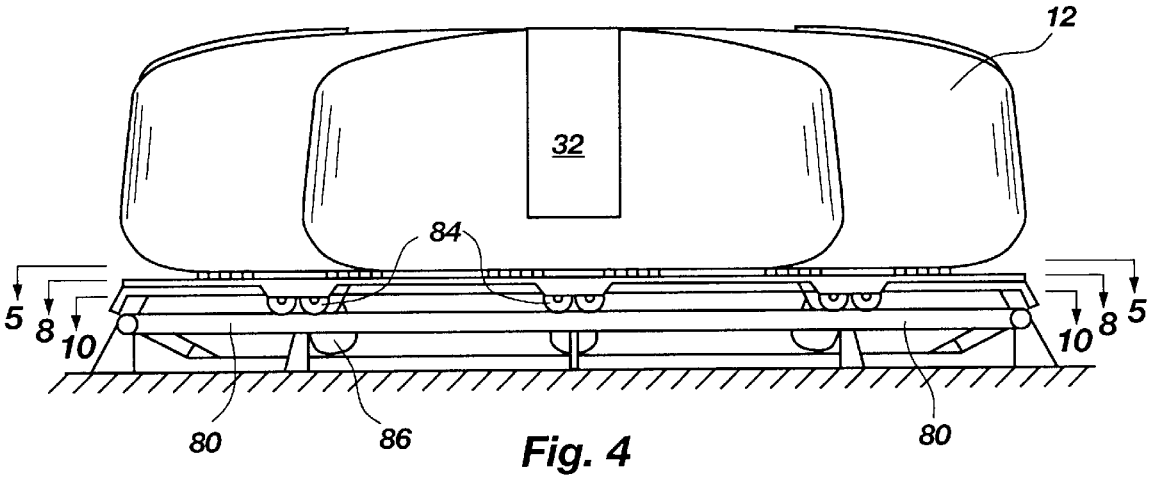
FIG. 4 is an elevation side view of the embodiment of FIGS. 1 and 3.

As shown in FIGS. 3–4, several pods 12 may operate simultaneously, preferably being symmetrically disposed about and orbiting the axis of orbit 14. This configuration has the advantage that the pods will counter balance one another.

Figure 5:
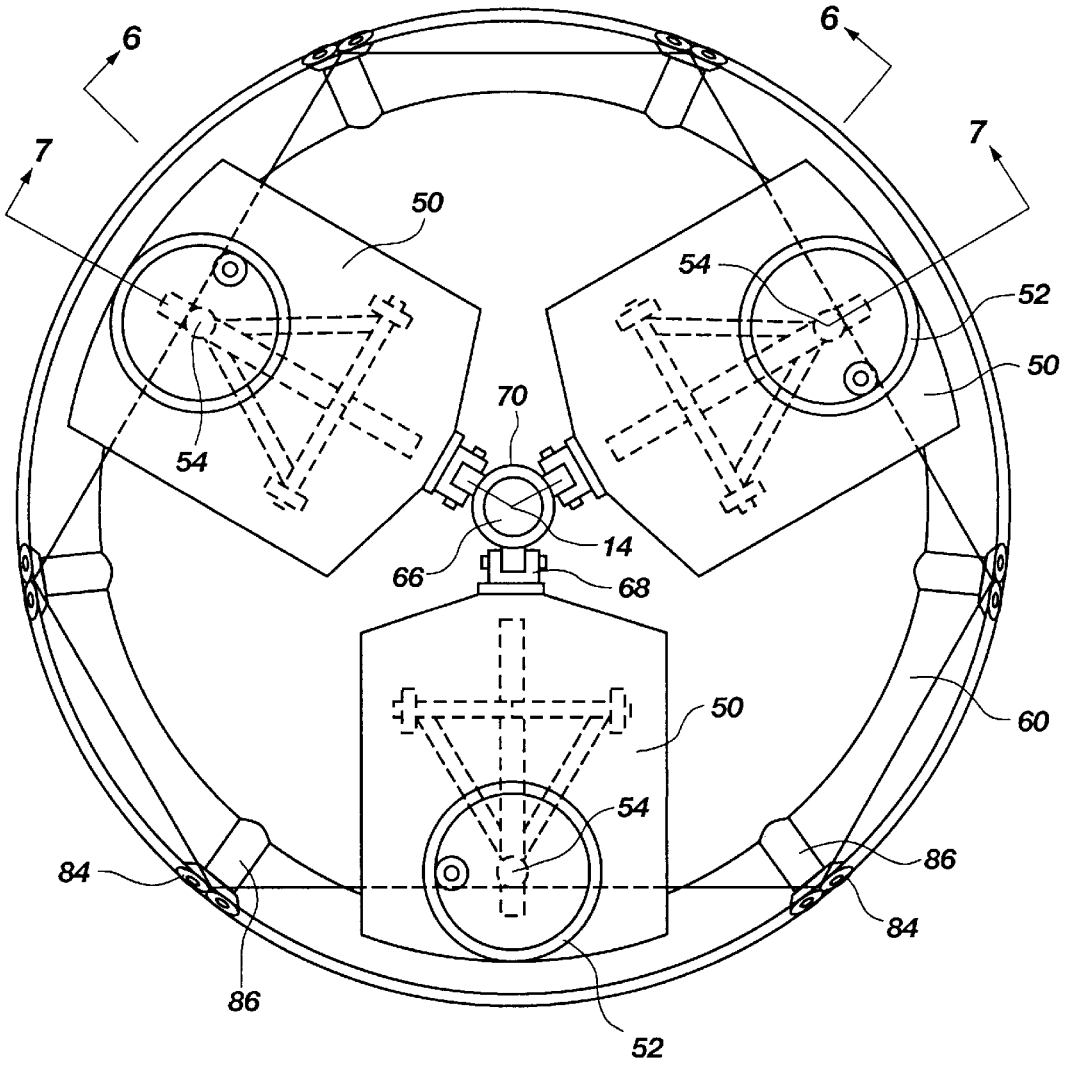
FIG. 5 is a top sectional view of the apparatus of FIG. 4, taken along section 5—5.
Figure 6:
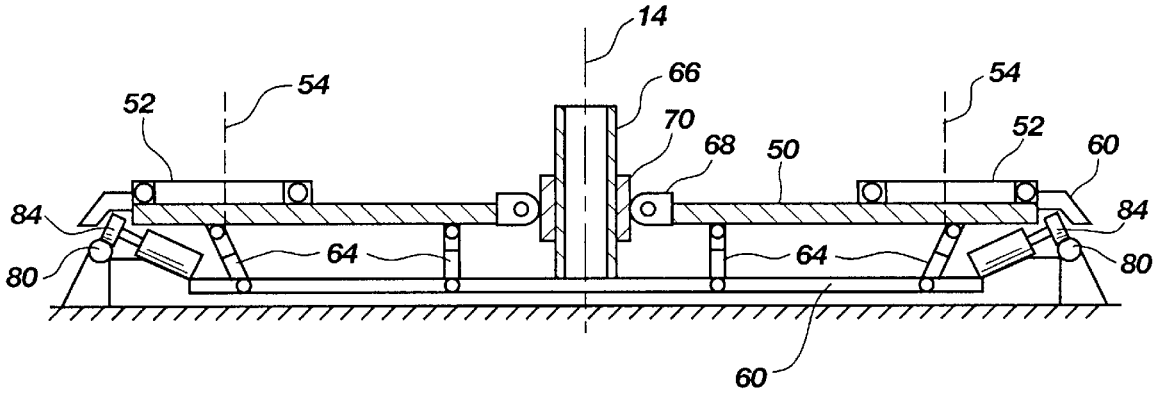
FIG. 6 is a side, cross sectional view of the present invention taken along section 6—6 of FIG. 5.
Figure 7:
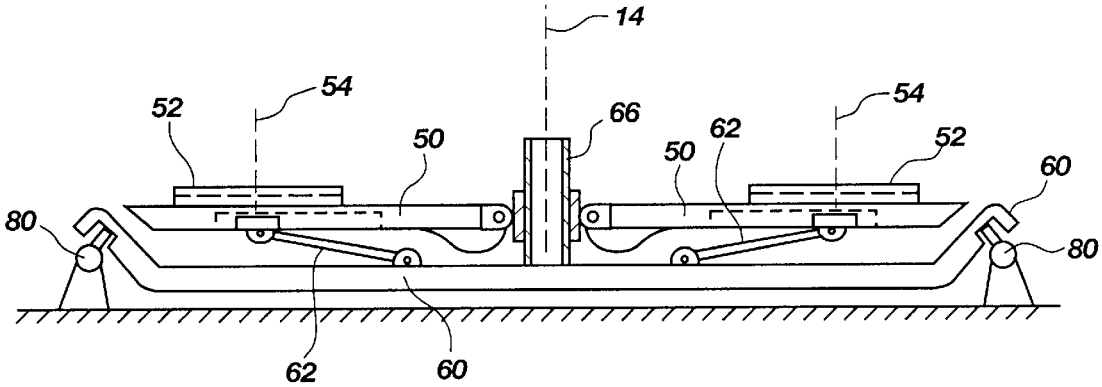
FIG. 7 is a side, cross sectional view of the present invention taken along section 7—7 of FIG. 5.

As shown in FIGS. 5–7, the pod 12 is rotatably attached to a motion or flying platform 50 by a rotatable bearing 52. The pod 12 rotates on the rotatable bearing 52 about an axis of rotation 54 that is distinct from the axis of orbit 14. Thus, the pod 12 and passengers 20 may be oriented so they are facing toward or away from the axis of orbit 14 in order to impose forward acceleration or deceleration, respectively, upon the passengers. In addition, the pod 12 and passengers 20 may be rotated about the axis of rotation 54 simultaneously while being orbited about the axis of orbit 14 to create a sense of zero gravity or stall.

The rotatable bearings 52 may thus be described as a rotational bearing means disposed to intercouple the pods 12 to the flying platforms 50 for enabling rotational movement of said pods 12 with respect to the platforms 50.

The flying platform 50 is movably attached to a motion base 60 by sway bars 62 and actuators 64. The sway bars 62 are attached between the motion base 60 and the flying platform 50 to stabilize the flying platform 50 and pod 12 and prevent unwanted yaw movement. As shown most clearly in FIG. 10, the motion base comprises a framework, preferably including a continuous perimeter member and a plurality of beams attached to said perimeter member and extending radially inwardly into contact with a common center piece, such as column 66.

The actuators 64 are also attached between the motion base 60 and flying platform 50. The actuators 64 move the flying platform 50 and pod 12 in various directions and positions them at various angles. The actuators 64 may heave (move up and down), surge (move forward and backward), or sway (move side to side) the flying platform 50 and pod 12. The actuators 64 may also pitch (angle up or down), roll (angle side to side), or turn the flying platform 50 and pod 12. These movements apply a force on the passengers 20 and give the passengers 20 a sense of repositioning movement. For example, the actuators 64 may heave the flying platform 50 and pod 12 rapidly up and down to simulate travel over an uneven terrain. The actuators 64 may pitch or roll the flying platform 50 and pod 12 to simulate a change in direction of travel. The actuators 64 may be of any type such as hydraulic cylinders or electric push rods.

The flying platform 50 may also movably attached to the column 66 which is concentric with the axis of orbit 14 and attached to the motion base 60. The flying platform 50 is preferably attached to the column 66 by a universal joint 68 and a bearing collar 70, which collectively comprise a link means movably attached to the column 66 and the platform 50 (i.e. carrying means) for stabilizing the platform 50 while still permitting movement of said carrying means about all degrees of freedom. The universal joint 68 and the bearing collar 70 allow the flying platform 50 and pod 12 to move under the action of the actuators 64 with respect to the column 66 and motion base 60. The bearing collar 70 moves up and down on the column 66. The column 66 stabilizes the flying platforms 50 and maintains the orbital motion of the flying platforms 50 about the axis of orbit 14.

Figure 8:
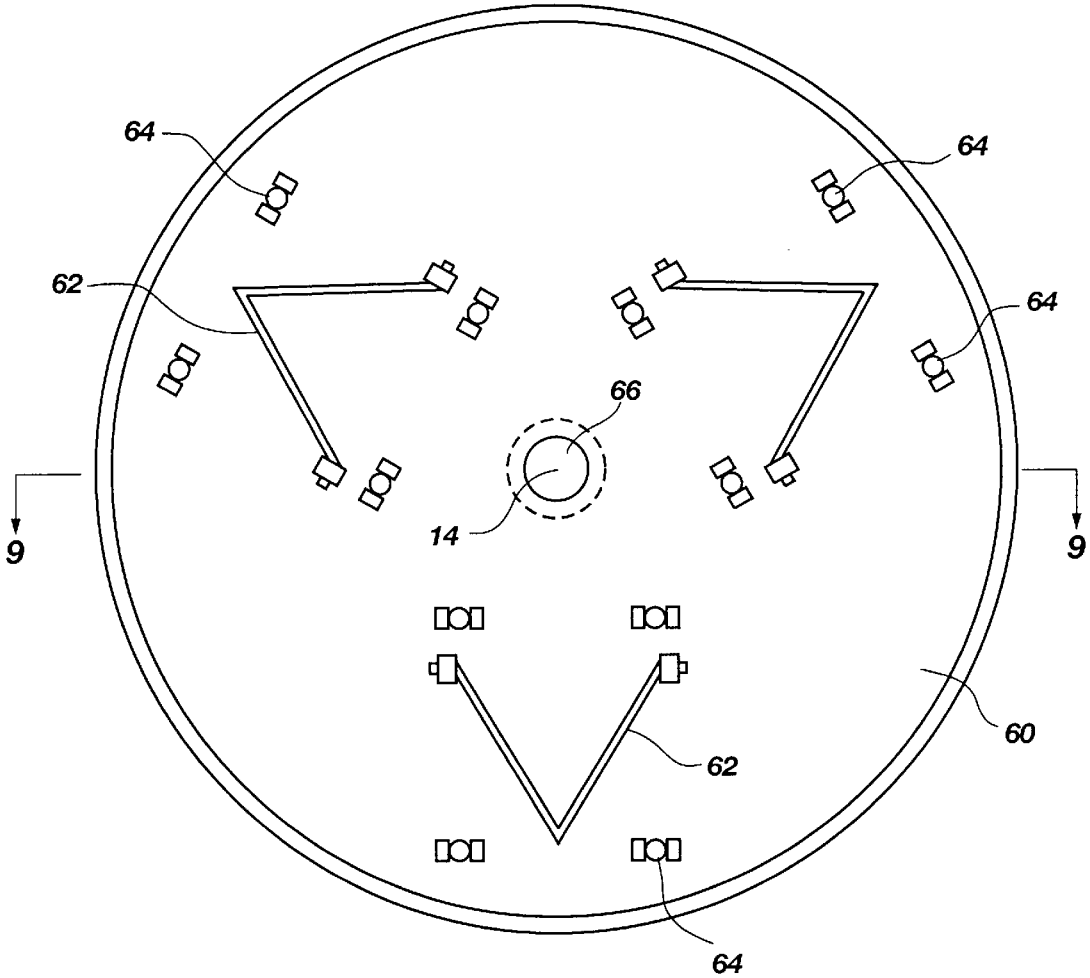
FIG. 8 is a top view of a preferred embodiment of the present invention taken along section 8—8 of FIG. 4.
Figure 10:
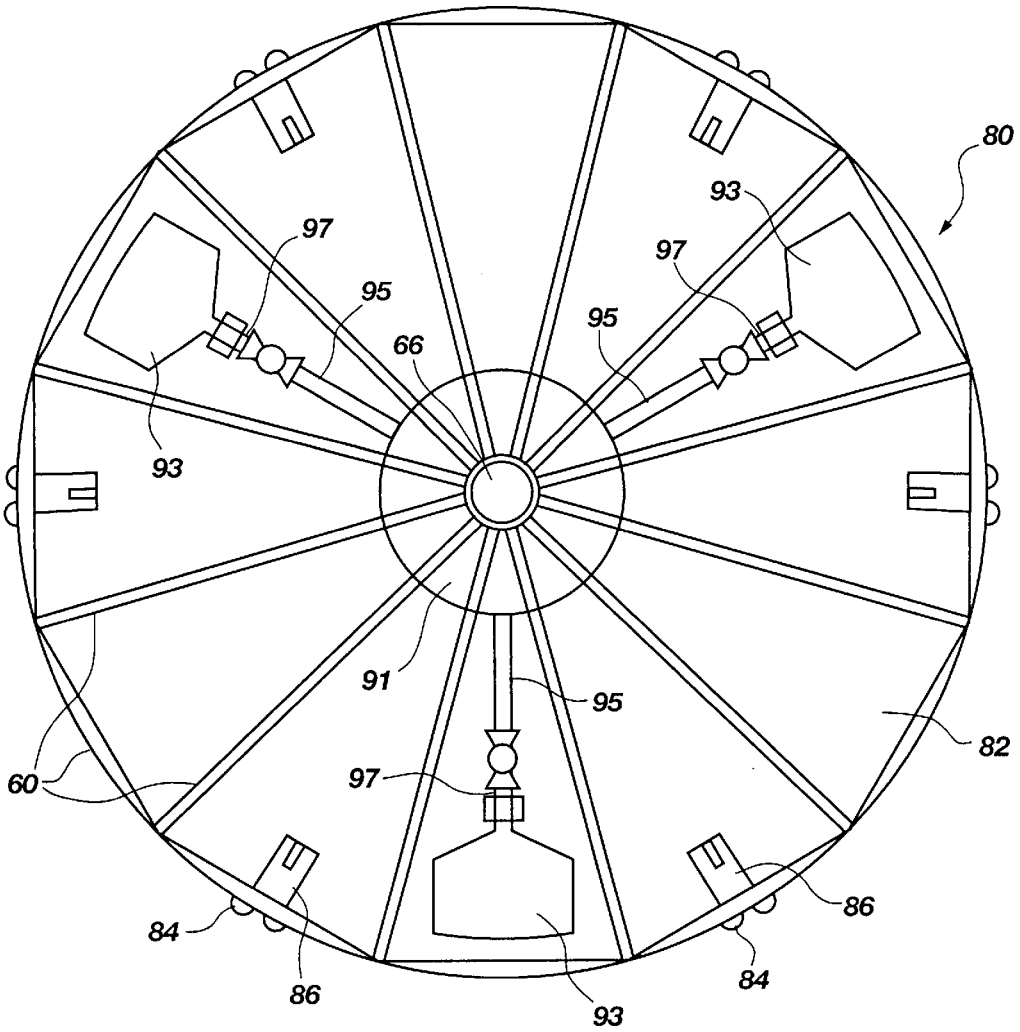
FIG. 10 is a top view of a preferred embodiment of the present invention taken along line 10—10 of FIG. 4.
Figure 9:
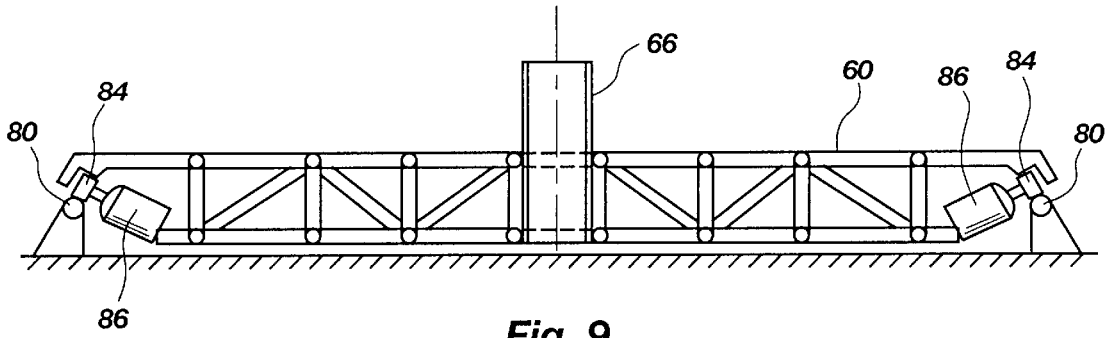
FIG. 9 is a side, cross sectional view of the present invention taken along line 9—9 of FIG. 8.

As illustrated in FIGS. 8–10, the motion base 60 is disposed on a circular track 80. The circular track 80 defines a circular motion path about which the motion base 60 is moved. The movement of the motion base 60 about the circular track 80 also orbits the pod 12 about the axis of orbit 14 and creates a centripetal force on the passengers 20.

The motion base 60 preferably consists of a space frame comprising a plurality of pie shaped members 82. The column 66 is attached to the motion base 60 concentric with the axis of orbit 14. The motion base 60 is preferably disposed on the track 80 by way of a plurality of rotational bearing members, such as wheels 84 of any other suitable bearing members. The wheels 84 are turned by a plurality of motors 86 attached to the wheels 84. Alternatively, the motion base 60 may have a central axle that is turned by a motor rather than individual wheels.

Figure 11:
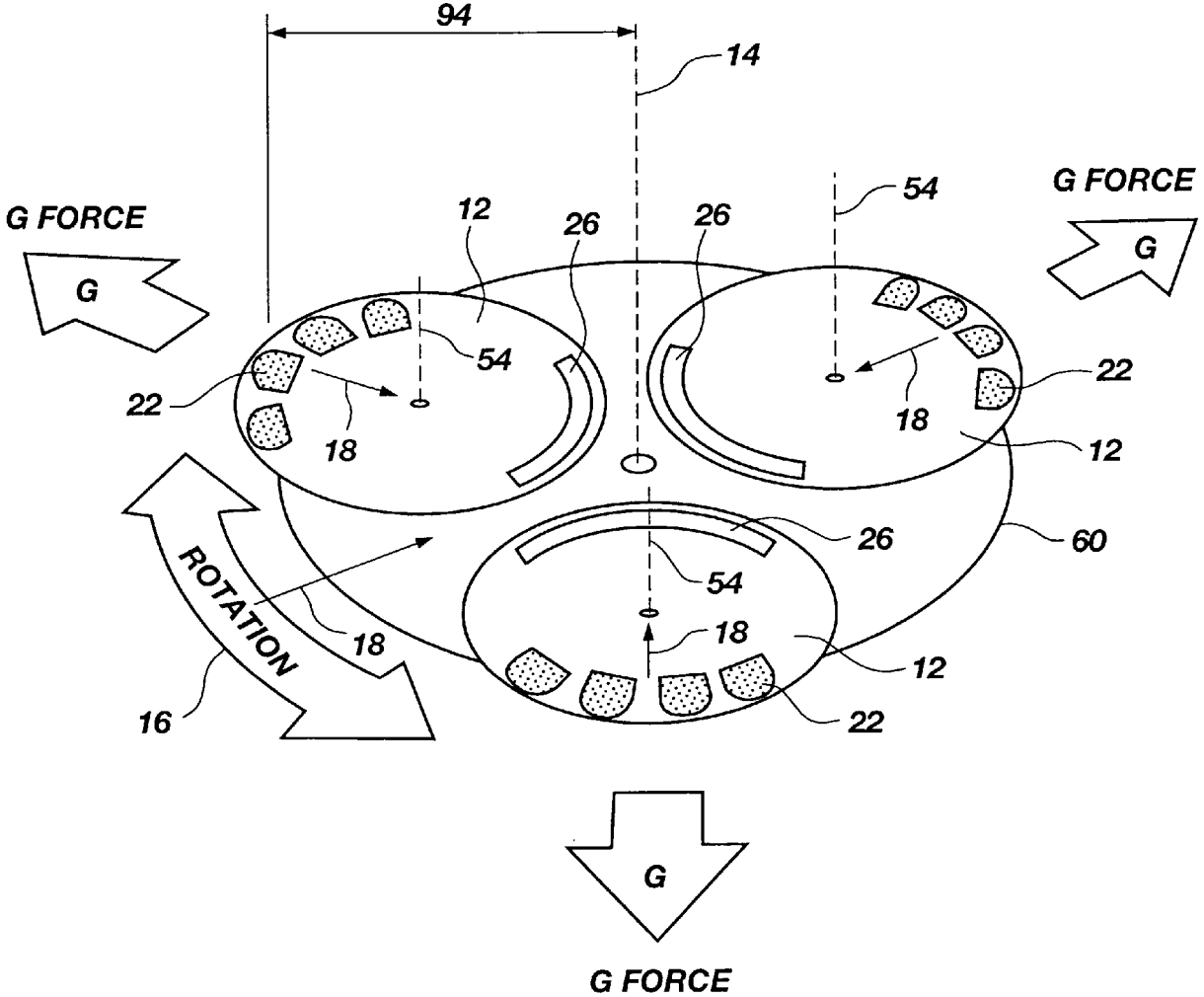
FIG. 11 is a schematic view of a preferred embodiment of the present invention using centripetal force to create the perception of forward acceleration.
Figure 12:
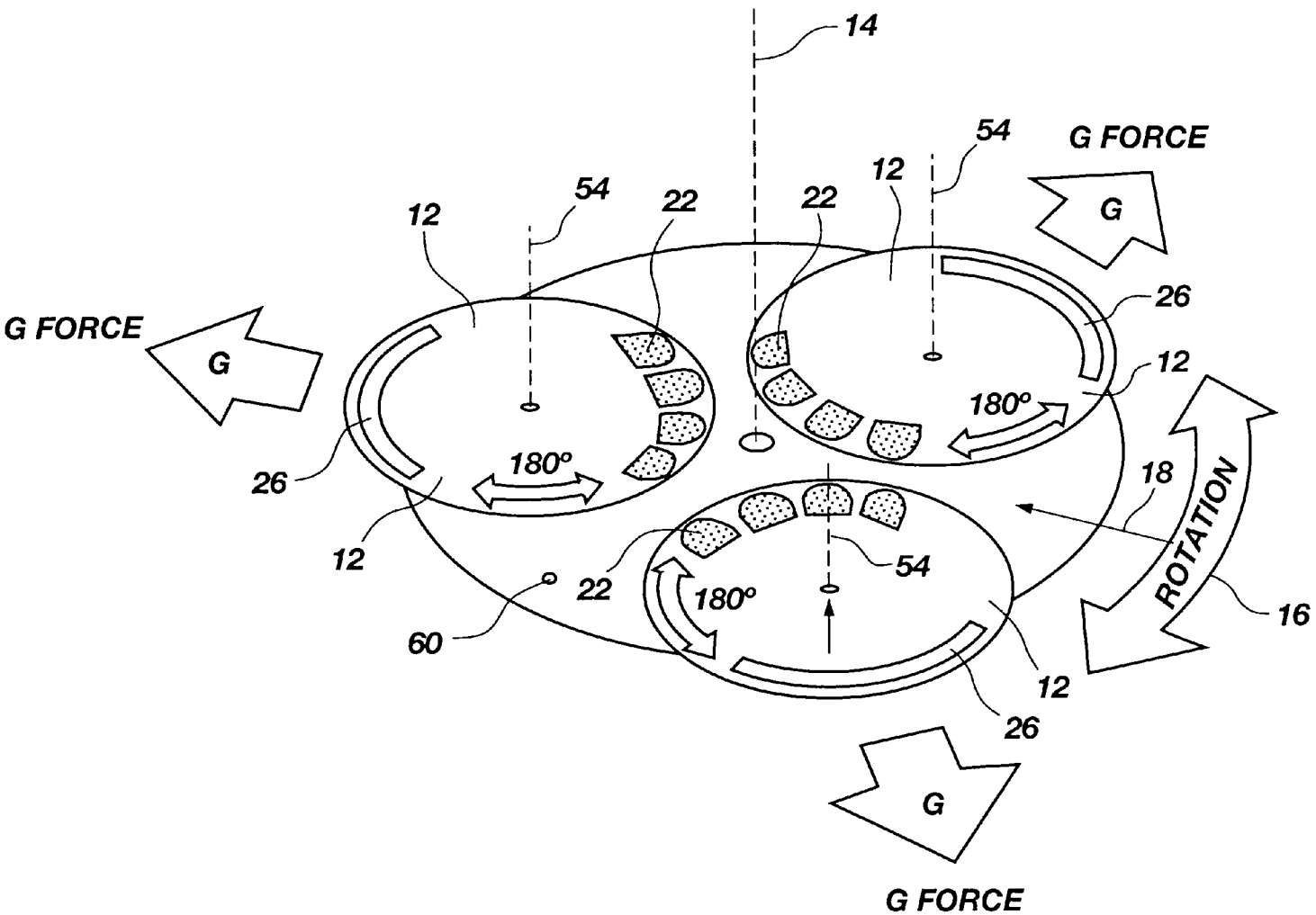
FIG. 12 is a schematic view of a preferred embodiment of the present invention using centripetal force to create the perception of deceleration.
Figure 13:
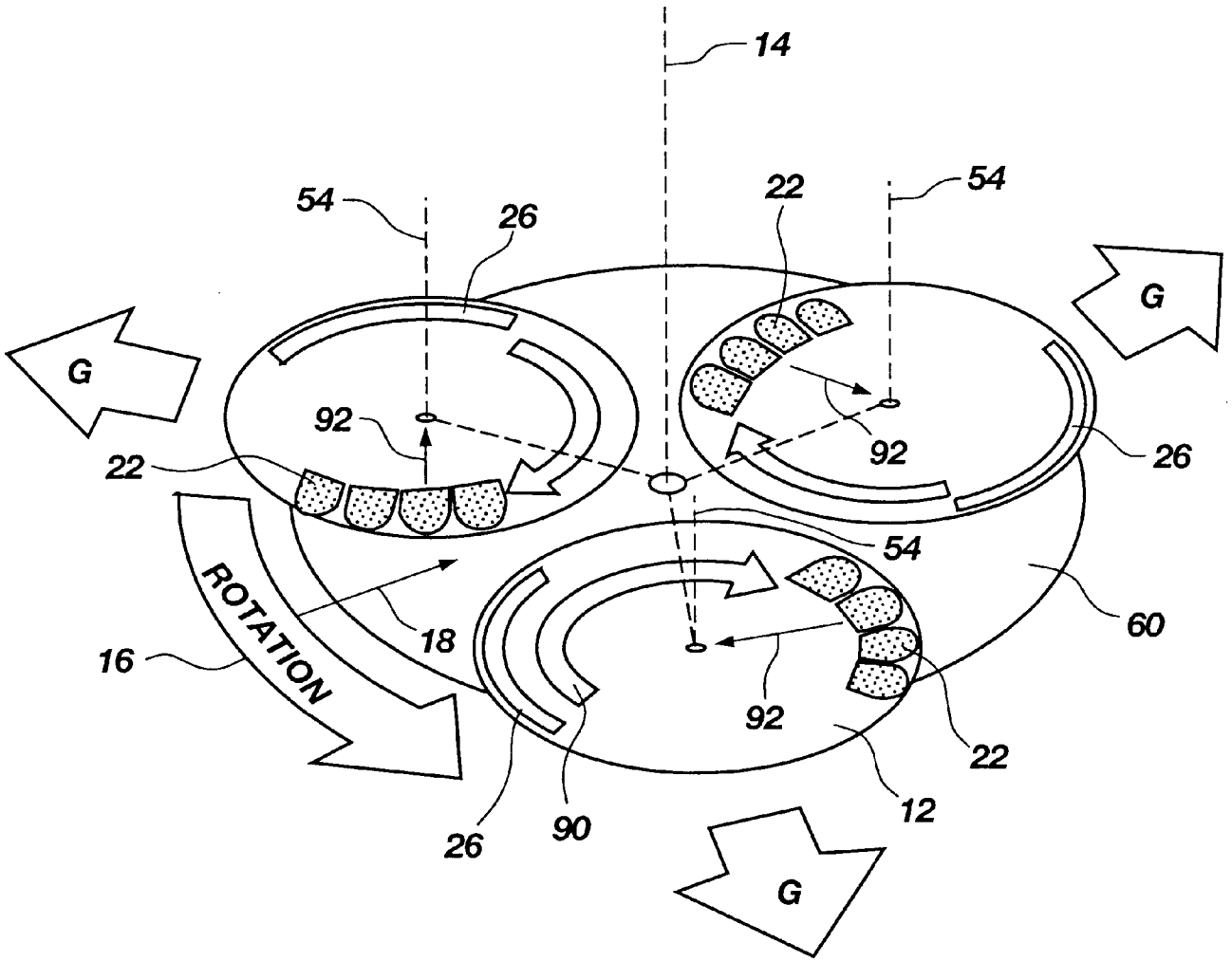
FIG. 13 is a schematic view of a preferred embodiment of the present invention using an axis of rotation distinct from the axis of orbit to create the perception of zero-gravity.

Referring now to FIGS. 11–13, the operation of the device 10 is shown schematically. As the pods 12 are orbited about the axis of orbit 14, a centripetal force 18 is created that acts on the passengers 20. If the passengers 20 are facing towards the axis of orbit 14, as shown in FIG. 11, the centripetal force 18 pushes against the passengers 20 and makes the passengers 20 feel as if they are being pushed back into their seats, thus simulating the effect of forward acceleration on the passenger 20. The centripetal force 18, simulating a forward acceleration, may be combined with movement from the actuators 64 and other sensory stimulus, such as the visual display, to enhance the motion. For example, the pod 12 may be orbited about the axis of orbit 14 while the visual display 26 is showing an airport runway from the perspective of a plane taking off, the sound system 30 is making engine noises, the actuators 64 are shaking the pod 12, a smell of exhaust is introduced into the pod 12, and the heat is increased in the pod 12 to give a realistic and sustained simulation of a departing aircraft. In prior art simulators, the effect of taking off could only be accomplished by pitching the flying platform forward. The visual display had to be relied upon to carry the rest of the simulation because there was no way of introducing a centripetal force.

Likewise, to simulate a deceleration, as shown in FIG. 12, the pod 12 is rotated about the axis of rotation 54 so that the passengers 20 are facing away from the axis of orbit 14. As the pod 12 is orbited about the axis of orbit 14, the centripetal force pushes against the passengers 20 and makes the passengers 20 feel as if they are being pushed out of their seats as is readily understandable to those of ordinary skill in the relevant physics, thus simulating the effect of deceleration on the passengers 20.

As shown in FIG. 13, as the pod 12 is rotated about the axis of rotation 54 (shown schematically at 90) a second centripetal force 92 is created. Thus, as the pod 12 orbits the axis of orbit 14 and the pod 12 rotates about the axis of rotation 54, two centripetal forces 18 and 92 are applied to the passengers 20. As the passengers 20 are rotated about the axis of rotation 54 so that they face the axis of orbit 14, the two centripetal forces 18 and 92 will combine to form a force of greater magnitude. As the passengers 20 are rotated about the axis of rotation 54 so that they face away from the axis of orbit 14, the two centripetal forces 18 and 92 will act against each other to form a force of lesser magnitude. The rotation of the pod 12 about the axis of rotation 54 and the orbit of the pod 12 about the axis of orbit 14 may be coordinated so that when the two centripetal forces 18 and 92 act against each other, the two centripetal forces 18 and 92 substantially cancel each other out. The effect of the pod 12 and passenger 20 rotating about the axis of rotation 54 will be to apply a large centripetal force 18 and 92 on the passenger 20 and then to apply substantially no force. The effect will be to simulate a zero gravity or stall.

From the perspective of an observer outside of the ride, a centripetal force is applied to the passengers which acts toward the axis of orbit 14. From the perspective of the passenger (the passenger being in an accelerated frame of reference), the force applied is a G-force or "centrifugal" force which appears to act in a direction away from the axis of orbit 14.

As shown in FIGS. 11–13, the radius of orbit 94, or the distance of the passenger 20 from the axis of orbit 14, is significant to the operation of the device 10. The magnitude of the centripetal force 18 is a function of the radius of orbit 94 and the speed of orbit. The smaller the radius of orbit 94 the faster the pod 12 and passengers 20 must be orbited in order to create a desired magnitude of centripetal force 18. If the radius of orbit 94 is larger, then the pod 12 and passengers 20 will not need to be orbited as fast to create a desired magnitude of centripetal force 18.

The radius of orbit 94 is also important to the effect of the motion on the passenger 20. If the radius of orbit 94 is too small, the passenger 20 will feel the orbital motion of the pod 12 about the axis of orbit 14. The feeling of orbital motion may distract from the overall effect of the acceleration or make the passenger 20 experience motion sickness. If the radius of orbit 94 is large, the passenger is less likely to feel motion sickness or be distracted by the orbital motion of the pod 12.

In order to apply a centripetal force 18 to the passengers 20 without making the passengers 20 aware that the pod 12 is in orbital motion, the pod 12 may be slowly accelerated from a stationary position to the desired speed of orbital rotation. The gradual increase in orbital velocity will cause a gradual increase in the magnitude of the centripetal force 18 without the passenger 20 feeling the orbital motion of the pod 12. The passenger can be distracted from the gradual development of this centripetal force by lights, sound and other sensory stimuli.

Figure 15:
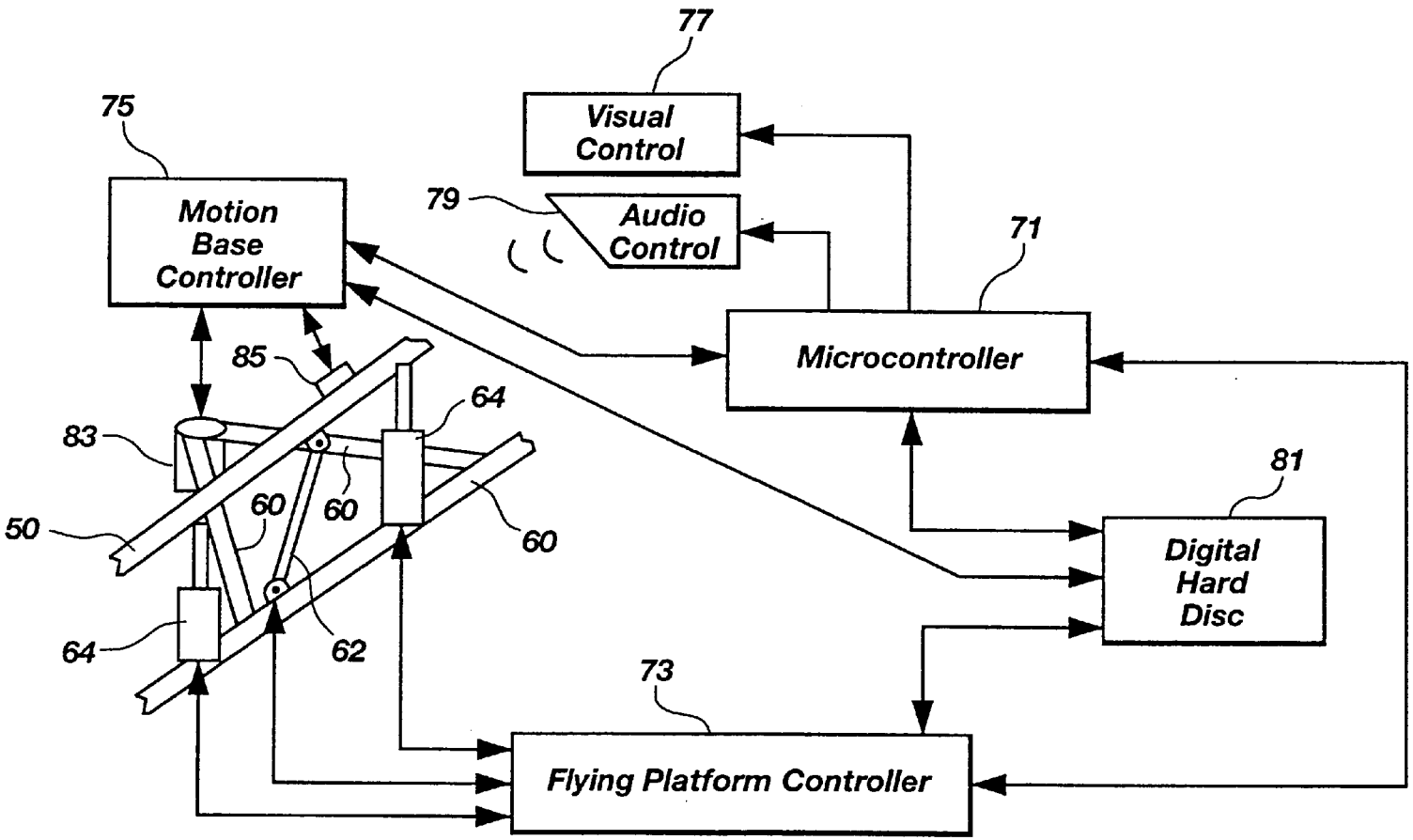
FIG. 15 is a simplified block diagram schematically illustrating one possible embodiment of the control circuitry arrangement for electronically operating the embodiment of the invention illustrated in FIGS. 1–10.

Referring now to FIG. 15, there is shown a simplified block diagram of conventional control circuitry components which could be employed to operate the invention described in FIGS. 1–10. The control circuitry embodiment of FIG. 19 is simply one example of the electronics which might be employed to provide the functional operations described herein, as may be readily understood by one of ordinary skill in the field of control circuitry. There is shown a microcontroller 71 electronically connected to a flying platform controller 73, a motion base controller 75, a visual control 77, an audio control 79, and a digital hard disk 81. The microcontroller 71 may comprise a microprocessor chip of a computer, or any other suitable electronic controlling device which may be programmably operable to control the various components to which it is electronically connected.

The visual control 77 would be electronically connected to the visual displays 26 and 28 of FIG. 2, and the audio control 79 would be electronically connected to the sound system 30 of FIG. 2. The visual control 77 and audio control 79 receive control signals from the microcontroller 71.

The actuator 64 and sway bars 62 are preferably of a known hydraulic type, and receive drive signals from the flying platform controller 73 for controlling the motion of the flying platform 50. A rotational drive apparatus 83 may be any suitable turning device for imparting rotational motion, and receives drive signals from motion base controller 75 for rotating the motion base 60. Command signals may be provided from a storage medium such as a digital hard disk 81 to the microcontroller 71, and if desired also to the flying platform controller 73 and the motion base controller 75. Sensors 85 are attached to the flying platforms 50 for sensing any weight changes therein, and may communicate with the motion base controller 75 as shown, or the microcontroller 71, as explained in more detail below.

Referring now to FIGS. 1, 10 and 15, one important key aspect of the invention is the concept of counter-balancing the pods 12 about the axis of orbit 14. In specific reference to FIG. 10, this counter-balancing effect may be accomplished by any suitable balancing means, and preferably by provision of a central storage tank 91, pod tanks 93 which are disposed on either the pods 12 or the flying platforms 50 (not shown in FIG. 10), fluid communication channels 95 disposed to enable fluidic communication between the storage tank 91 and the pod tanks 93, and control valve/pumping means 97 for pumping fluid alternately into and from the pod tanks 93. The valve/pumping means 97 may be operatively controlled by the sensors 85 and controllers 75 and 71 (shown in FIG. 15), or by any other suitable controlling means.

The pods 12 and flying platforms 50 are preferably disposed in a symmetric orientation about the axis of orbit 14 and cooperatively form a carrying means having a center of mass which coincides with the axis of orbit 14. However, it will be appreciated that the center of mass of the carrying pod system will repeatedly shift away from the axis of orbit 14 with the entrance and exit of varying numbers of passengers into and from the individual pods 12.

Therefore, in order to maintain the collective center of mass of the pods 12 and flying platforms 50 to be substantially coincident with the axis of orbit 14, the storage tank 91, pod tanks 93, fluid channels 95, valve/pumping means 97 (all in FIG. 10) and the sensors 85 (FIG. 15) cooperatively operate as a variable mass balancing means for counter-balancing the pods 12 about the axis of orbit 14 responsive to changes in position of the collective center of mass of said pods, to thereby maintain said center of mass substantially coincident with the axis of orbit 14.

As passengers enter and exit the pods 12 between rides, the center of mass will shift, but before the ride begins the sensors 85 will sense a weight differential between the pods 12, permitting the microcontroller 71 and/or the motion base controller 75 to send electronic signals to the valve/pumping means 97 to either (i) inject fluid from the storage tank 91 into one or more of the pods tanks 93, or alternatively (ii) remove fluid from one or more of the pod tanks 93 back into the storage tank 91, to thereby shift the collective center of mass of the pods 12 and flying platforms 50 back into coincidence with the axis of orbit 14. The fluid contained in the storage tank 91 and pods tanks 93 is preferably water, although any suitable fluid or solid-mass shifting mechanism (such as a worm gear may be used. This concept of mass balancing the pod carrying system about the axis of orbit 14 is applicable to all embodiments disclosed herein, including those of FIG. 14 to be discussed below.

Referring now again to the actuator 64 and sway bars 62, these devices cooperatively form a repositioning means for repositioning the pods 12 relative to the axis of orbit during rotation of the motion base 60 and without repositioning the axis of orbit 14, by causing a second movement of the pods 12 in addition to their orbital movement about the axis of orbit 14. The second movement may include the motions described above, including heave, surge, sway, pitch, roll or turn as those motions were described above.

The second movement of the pods 12 caused by the actuator 64 and sway bars 62 may also be described in reference to FIG. 3, wherein is shown an orbital movement path 61 of the pods 12, a rotational axis 63 bisecting a pod 12 and the axis of orbit 14 and extending perpendicularly with respect to said axis of orbit 14, and another rotational axis 65 bisecting the pod 12 but extending tangentially with respect to the orbital movement path 61. The second movement might therefore be selected from the group consisting of:

(a) upward vertical movement of the pod 12 in a parallel direction with respect to the axis of orbit 14;

(b) downward vertical movement of the pod 12 in a parallel direction with respect to the axis of orbit 14;

(c) inward horizontal movement of the pod 12 toward and perpendicular to the axis of orbit 14, also described as being in the direction of axis 63;

(d) outward horizontal movement of the pod 12 away from and perpendicular to the axis of orbit 14, and thus also in the direction of the rotational axis 63;

(e) rotational movement of the pod 12 about the rotational axis 63, along some defined arc length which may be a short or a long arc length, such that the rotational movement may also be described as a short, abrupt arcuate movement; and (f) rotational movement of the pod 12 about the tangential rotational axis 65, also in the form of a short, abrupt arcuate movement.

Referring again now to the orbital motion of the pods, as schematically indicated by arrow 16 in FIGS. 11–13, the speed of such orbital movement may be as slow or as fast as desired. For example, that orbital movement indicated at arrow 16 may be a very slow orbit, sufficiently slow so as to be imperceptible to the motion sensing capacity of the passengers seated within the pods 12. The orbital speed could also be gradually accelerated at such a slow acceleration that the passengers also would not be able to perceive the acceleration, with the pods picking up orbital speed to thereby impose a centripetal acceleration for movement upon the passengers without their knowledge.

Figure 14:
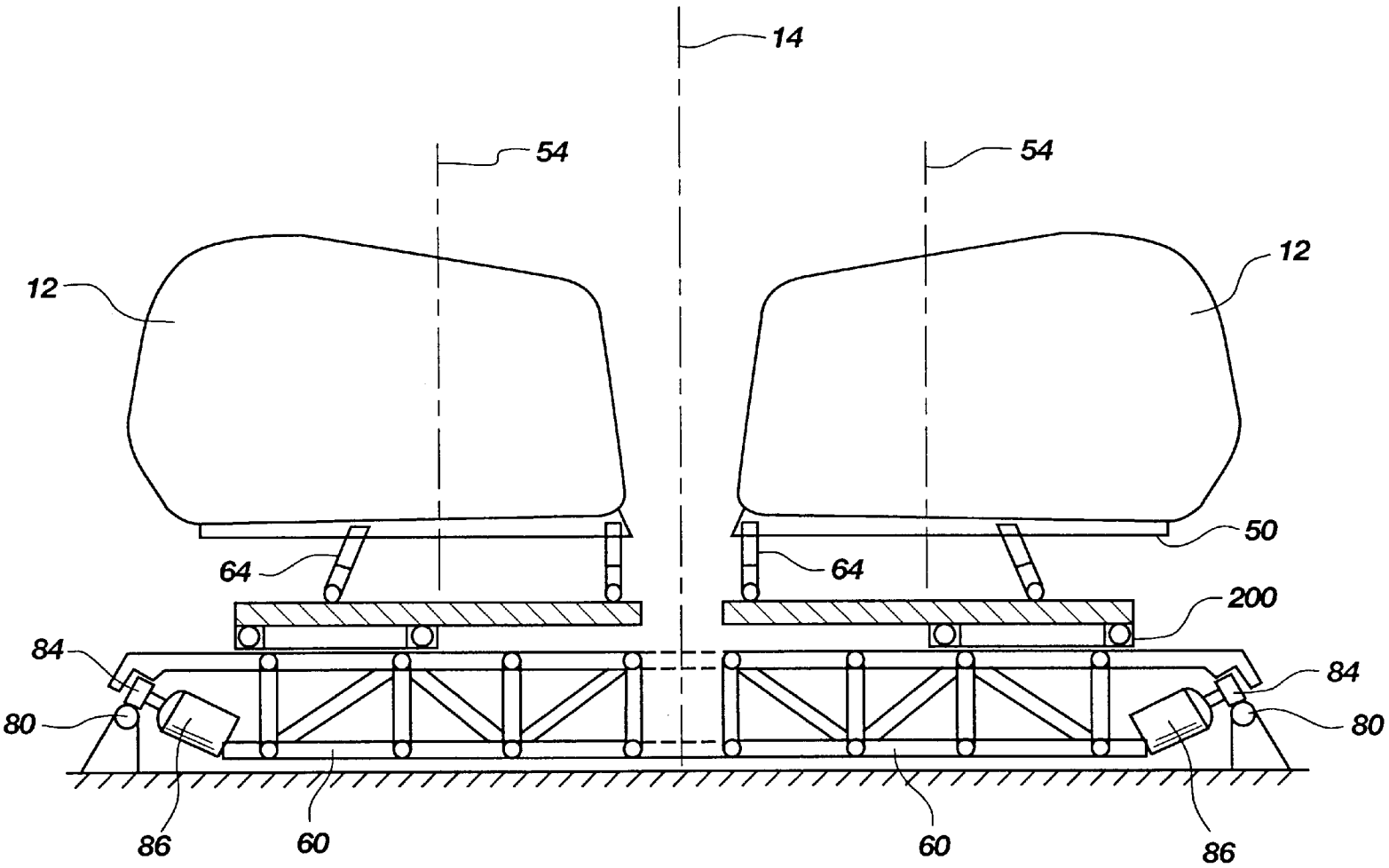
FIG. 14 is an elevation cross sectional side view of an alternative embodiment of the present invention.

An alternative embodiment to that illustrated in FIGS. 1–10 is shown in FIG. 14, in which the rotational bearing 200 is attached between the motion base and flying platform instead of being attached between the flying platform and the pod as in FIGS. 5–7. Therefore, components in FIG. 14 are given the same reference number as their like components in FIGS. 1–3 and the above description with respect to FIGS. 1–14 is herein incorporated by reference to the description of the alternative embodiment as shown in FIG. 14.

Therefore, in the alternative embodiment of FIG. 14, the flying platform 50 and the actuators 64 rotate about the axis of rotation 54 with the pod 12. Because the flying platform 50 rotates in the alternative embodiment, there is no need for a universal joint, bearing collar, or vertical column to attach the flying platform 50 to the motion base 60. Instead, the flying platform 50 is rotatably attached to the motion base 60 by rotational bearing 200.

The means for orbiting the pods 12 may thus comprise the track 60 and wheels 84 and associated motor. If desired, the means for orbiting the pods 12 may operate to rotate the motion base (60 in FIGS. 1–10) at a sufficiently slow rotational velocity such that the orbital movement and centripetal force is beyond the motion-sensing capacity of the at least one passenger and are thereby imperceptible to said at least one passenger.

The visual displays 26 and 28 may be described as a means for producing a motion picture display confined to orbital movement with the pods 12 in a manner sufficient to enable said motion picture display to be viewed by a seeing passenger being carried by said pods 12.

Similarly, the sound system 30 may be described as an audio means for producing a source of sound which may be confined to orbital movement with the pods 12 in a manner sufficient to enable said source of sound to be heard by a hearing passenger being carried by said pods 12.

The invention may also comprise any suitable vapor means, shown schematically as item 31 in FIG. 2, for producing a source of vapor which may be positioned to be confined to orbital movement with the pods 12 in a manner sufficient to enable said source of vapor to be viewable by a seeing passenger being carried by said pods 12. The vapor means 31 may comprise a mist jet device, for example.

The invention may also comprise any suitable odor means, shown schematically as item 33 in FIG. 2, for producing a source of odor which may be positioned to be confined to orbital movement with the pods 12 in a manner sufficient to enable said source of odor to be smelled by a smelling passenger being carried by said pods 12.

The invention may also comprise any suitable interactive means, shown schematically as item 35 in FIG. 2, for receiving a response from the passengers 20, forming an electronic control signal indicative of said response and sending said control signal to the microcontroller 71 for controlling the rotating means responsive to said response from the passengers 20. The interactive means 35 may be adapted and designed to receive one or more different types of passenger response, such as an audible command, a bodily movement command, and a manual command input to a keypad input device that might be incorporated as a part of the interactive means 35 or electronically connected therewith.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A centripetal acceleration movement apparatus comprising:

a base support having a rotatable portion rotatably disposed about a first axis;

a carrying means having a center of mass and being attached to the rotatable portion of the base support and being positioned remotely with respect to the first axis for carrying at least one passenger, the carrying means comprising a plurality of spaced-apart seating assemblies for carrying a plurality of passengers, each seating assembly having its own individual center of mass positioned remotely with respect to the first axis;

a rotating means for rotating the rotatable portion of the base support about the first axis and thereby causing the attached carrying means to (i) orbit said first axis along an orbital movement path and (ii) apply a centripetal force to the at least one passenger;

a motion picture means for producing a motion picture display confined to orbital movement with the carrying means in a manner sufficient to enable said motion picture display to be viewed by a seeing passenger being carried by said carrying means; and variable balancing means for counter-balancing the carrying means about the first axis responsive to changes in position of the center of mass of said carrying means, to thereby maintain said center of mass of said carrying means substantially coincident with said first axis, the variable balancing means further comprising:

a central storing means for storing fluid therein;

a plurality of individual tanks disposed in a fixed relationship with respect to the plurality of spaced-apart seating assemblies, respectively, said individual tanks being disposed in fluidic communication with the central storage means;

valve/pumping means for (i) selectively pumping fluid in selectable quantities from the central storage means to the individual tanks, and (ii) selectively pumping fluid in selectable quantities from the individual tanks to the central storage means; and sensing means for sensing weight changes in the seating assemblies and controlling the valve pumping means responsive to said weight changes by selecting quantities of fluid to be pumped into and from the individual storage tanks.

2. A centripetal acceleration movement apparatus comprising:

a base support having a rotatable portion rotatably disposed about a first axis;

a carrying means having a center of mass and being positioned on the rotatable portion of the base support remotely with respect to the first axis for carrying at least one passenger, the carrying means comprising a plurality of spaced-apart seating assemblies for carrying a plurality of passengers, each seating assembly having its own individual center of mass positioned remotely with respect to the first axis;

a rotating means for rotating the rotatable portion of the base support about the first axis and thereby causing the attached carrying means to (i) orbit said first axis along an orbital movement path and (ii) apply a centripetal force to the at least one passenger; and variable balancing means for counter-balancing the carrying means about the first axis responsive to changes in position of the center of mass of said carrying means, to thereby maintain said center of mass of said carrying means substantially coincident with said first axis, the variable balancing means further comprising:

a central storage means for storing fluid therein;

a plurality of individual tanks disposed in a fixed relationship with respect to the plurality of spaced-apart seating assemblies, respectively, said individual tanks being disposed in fluidic communication with the central storage means;

valve/pumping means for (i) selectively pumping fluid in selectable quantities from the central storage means to the individual tanks, and (ii) selectively pumping fluid in selectable quantities from the individual tanks to the central storage means; and sensing means for sensing weight changes in the seating assemblies and controlling the valve pumping means responsive to said weight changes by selecting quantities of fluid to be pumped into and from the individual storage tanks.

3. A centripetal acceleration movement apparatus comprising:

a base support having a rotatable portion rotatably disposed about a first axis;

a carrying means having a center of mass and being attached to the rotatable portion of the base support and being positioned remotely with respect to the first axis for carrying at least one passenger, wherein the carrying means further comprises a plurality of passenger enclosures configured and dimensioned for substantially encapsulating passengers therein;

a rotating means for rotating the rotatable portion of the base support about the first axis and thereby causing the attached carrying means to (i) orbit said first axis along an orbital movement path and (ii) apply a centripetal force to the at least one passenger;

a motion picture means for producing a motion picture display confined to orbital movement with the carrying means in a manner sufficient to enable said motion picture display to be viewed by a seeing passenger being carried by said carrying means;

wherein the base support further comprises a circular movement track, the rotatable portion of the base comprising at least one motion surface slid ably disposed on the circular movement track, said base support also comprising a plurality of rotational members rotatably disposed on the motion surface, said rotational members being disposed in contact with the movement track;

wherein the motion surface comprises a framework having a continuous perimeter member and a plurality of beams attached to said perimeter member and extending radially inwardly into contact with a common center piece;

a plurality of platforms attached on top of the motion surface, wherein the carrying means comprises a plurality of seating assemblies respectively disposed on the plurality of platforms such that said platforms and seating assemblies are confined to movement with one another;

turning means for turning the platforms with respect to the motion surface;

audio means for producing a source of sound on the carrying means such that said source of sound is positioned to be confined to orbital movement with the carrying means in a manner sufficient to enable said source of sound to be heard by a hearing passenger being carried by said carrying means;

variable balancing means for counter-balancing the carrying means about the first axis responsive to change in position of the center of mass of said carrying means, to thereby maintain said center of mass of said carrying means substantially coincident with said first axis;

wherein the carrying means comprises a plurality of spaced-apart seating assemblies for carrying a plurality of passengers, each seating assembly having its own individual center of mass positioned remotely with respect to the first axis, said apparatus further comprising:

a repositioning means for repositioning at least one of the seating assemblies relative to the first axis during rotation of the base support and without repositioning said first axis, by causing a second movement of said seating assembly in addition to the orbital movement, said second movement being selected from the group consisting of:

(a) upward vertical movement in a parallel direction with respect to the first axis;

(b) downward vertical movement in a parallel direction with respect to the first axis;

(c) rotational movement about a rotational axis bisecting the seating assembly and the first axis and extending perpendicularly with respect to said first axis; and (d rotational movement about a rotational axis bisecting the seating assembly and extending tangentially with respect to the orbital movement path.

4. The apparatus of claim 3, further comprising:

vapor means for producing a source of vapor on the carrying means such that said source of vapor is positioned to be confined to orbital movement with the carrying means in a manner sufficient to enable said source of vapor to be viewable by a seeing passenger being carried by said carrying means;

odor means for producing a source of odor on the carrying means such that said source of odor is positioned to be confined to orbital movement with the carrying means in a manner sufficient to enable said source of odor to be viewable by a seeing passenger being carried by said carrying means; and programmable controlling means for controlling the rotating means in accordance with programmed command signals.

* * * * *